US007588408B2

(12) United States Patent
Tomassoni

(10) Patent No.: US 7,588,408 B2
(45) Date of Patent: Sep. 15, 2009

(54) WASTE PACKING APPARATUS AND WASTE COLLECTION VEHICLE

(75) Inventor: Gabe Tomassoni, Bracebridge (CA)

(73) Assignee: Fanotech Enviro Inc., Huntsville (CA)

( * ) Notice: Subject to any disclaimer, the term of this patent is extended or adjusted under 35 U.S.C. 154(b) by 512 days.

(21) Appl. No.: 11/289,992

(22) Filed: Nov. 30, 2005

(65) Prior Publication Data

US 2007/0122258 A1 May 31, 2007

(51) Int. Cl.
*G65F 3/14* (2006.01)

(52) U.S. Cl. ..... 414/513; 414/525.2; 414/525.5

(58) Field of Classification Search ..... 414/492, 414/513, 525.2, 525.5; 100/233
See application file for complete search history.

(56) References Cited

U.S. PATENT DOCUMENTS

| | | | | |
|---|---|---|---|---|
| 2,750,055 | A | 6/1956 | Huffines | |
| 2,826,318 | A * | 3/1958 | Beasley | 414/525.2 |
| 2,961,105 | A | 11/1960 | Shubin | |
| 3,325,024 | A * | 6/1967 | Shubin | 414/406 |
| 3,370,525 | A * | 2/1968 | Bowles | 100/48 |
| 3,615,028 | A | 10/1971 | Appleman et al. | |
| 3,615,029 | A | 10/1971 | Anderson | |
| 3,727,779 | A | 4/1973 | Herpich et al. | |
| 3,767,068 | A | 10/1973 | Herpich et al. | |
| 3,771,674 | A | 11/1973 | Clucker | |
| 3,797,680 | A | 3/1974 | Dennis | |
| 3,799,375 | A | 3/1974 | Herpich et al. | |
| 3,899,090 | A * | 8/1975 | Telesio | 414/513 |
| 3,938,679 | A | 2/1976 | Clucker et al. | |

(Continued)

FOREIGN PATENT DOCUMENTS

| | | |
|---|---|---|
| CA | 890260 | 11/1972 |

(Continued)

OTHER PUBLICATIONS

Publication entitled Use Your Front Loader as a Transfer Station, published by Wittke Iron Works Co. Ltd.

(Continued)

*Primary Examiner*—James Keenan
(74) *Attorney, Agent, or Firm*—Fitch, Even, Tabin & Flannery

(57) ABSTRACT

A packing device is disclosed and comprises a hopper and a packer mechanism. The hopper is for receiving waste and has a substantially arcuate interior bottom surface and an aperture opening into the interior of the hopper. The aperture has a base towards which the interior bottom surface extends. The packer mechanism is mounted in the hopper for reciprocating movement along an arcuate path defined at least in part by the bottom'surface. In use, waste introduced into the hopper deposits on the interior surface when the packer is retracted and is swept by the packer mechanism through the aperture during an extension stroke of the packer. The packer mechanism has a blade portion with a bottom engaging and resting on the bottom surface of the hopper, this surface supporting the packer in the hopper. At least one hydraulic cylinder drive is connected to the packer mechanism for moving this mechanism from its retracted position to an extended position and back again. A guide system is mounted on the hopper and the packer to guide the packer along the arcuate path. A vehicle incorporating the packing device, that collects, compacts, temporarily stores and transports waste, is also disclosed.

17 Claims, 12 Drawing Sheets

U.S. PATENT DOCUMENTS

| | | | | | |
|---|---|---|---|---|---|
| 3,942,661 | A | | 3/1976 | Clucker et al. | |
| 4,029,224 | A | | 6/1977 | Herpich et al. | |
| 4,050,594 | A | | 9/1977 | Gollnick | |
| 4,057,154 | A | | 11/1977 | Neufeldt | |
| 4,073,393 | A | | 2/1978 | McKenzie et al. | |
| 4,096,956 | A | | 6/1978 | Gaskin | |
| 4,180,365 | A | | 12/1979 | Herpich et al. | |
| 4,260,316 | A | | 4/1981 | Gollnick | |
| 4,298,306 | A | | 11/1981 | Chaudorge | |
| 4,316,695 | A | | 2/1982 | Knight, Sr. | |
| 4,460,307 | A | | 7/1984 | Durant et al. | |
| 4,551,055 | A | | 11/1985 | Demenais | |
| 4,892,454 | A | | 1/1990 | Behling et al. | |
| 4,954,040 | A | | 9/1990 | Smith et al. | |
| 5,123,801 | A | | 6/1992 | O'Daniel | |
| 5,316,430 | A | | 5/1994 | Horning et al. | |
| 5,324,161 | A | * | 6/1994 | Thobe | 414/525.2 |
| 5,427,496 | A | * | 6/1995 | Ratledge et al. | 414/525.2 |
| 5,584,642 | A | * | 12/1996 | Huntoon | 414/525.2 |
| 5,785,486 | A | * | 7/1998 | McNeilus et al. | 414/513 |
| 6,082,803 | A | * | 7/2000 | Klueger | 296/37.2 |
| 6,120,079 | A | | 9/2000 | Schiller | |
| 6,146,078 | A | | 11/2000 | Hamill et al. | |
| 6,234,739 | B1 | | 5/2001 | Smith et al. | |
| 6,250,873 | B1 | | 6/2001 | Straigier | |
| 6,435,802 | B1 | | 8/2002 | Schreiber et al. | |
| 6,485,244 | B1 | * | 11/2002 | McKinney | 414/525.52 |
| 6,854,949 | B2 | * | 2/2005 | Huang | 414/525.2 |
| 7,326,023 | B2 | * | 2/2008 | Hagenbuch | 414/513 |
| 2003/0152447 | A1 | | 8/2003 | Schreiber | |
| 2003/0202870 | A1 | | 10/2003 | Huang | |
| 2005/0053452 | A1 | * | 3/2005 | Tomassoni | 414/525.5 |
| 2005/0123384 | A1 | | 6/2005 | Tomassoni | |

FOREIGN PATENT DOCUMENTS

| | | |
|---|---|---|
| CA | 2386021 | 10/2003 |

OTHER PUBLICATIONS

Publication entitled Frink 6000 SL-One Man Side Loader, published by Frink Canada.

* cited by examiner

WASTE PACKING APPARATUS AND WASTE COLLECTION VEHICLE

FIELD OF THE INVENTION

The present invention relates to a waste packing apparatus and refuse collection vehicle that collects and transport waste.

BACKGROUND OF THE INVENTION

Side-loading waste collection vehicles, for curbside pickup of household waste or the like, are well known in the art. Generally, such vehicles have a housing including a hopper into which waste is deposited through a side opening. The waste can be transferred to a hold within the housing for temporary storage. Compaction is typically provided, either within the hold, or as part of the transfer process, so as to increase the capacity of the hold. Once the hold has reached its capacity, the waste can be ejected from the hold by tilting the housing upwards or by an ejecting blade or similar mechanism.

Prior art transfer/compaction mechanisms in vehicles of this type often suffer from mechanical complexity, relatively high weight or relatively large bulk. Mechanical complexity is disadvantageous, as it makes these mechanisms prone to failure, expensive to maintain and/or slow in operation. High weight is disadvantageous, as it reduces the payload that could otherwise be accommodated by the vehicle and thereby increases operating costs. Bulkiness reduces the volume that could otherwise be made available within the hold and thereby increases operating costs.

SUMMARY OF THE INVENTION

According to one embodiment of the invention, an apparatus for packing waste into a storage container includes a hopper for receiving the waste, this hopper including an interior space for waste, a substantially arcuate interior bottom surface, a first aperture for depositing waste into the interior space, and a second aperture for passage of the waste from the interior space to the storage container. The second aperture has a base towards which the bottom surface extends. A packer mechanism has a waste pushing face at one end thereof and is mounted in the hopper for reciprocating movement between a retracted position away from the second aperture and an extended position where the waste pushing face is in or adjacent to the second aperture. The reciprocating movement is along an arcuate path defined at least in part by the interior bottom surface of the hopper. The packer mechanism has a blade portion with the bottom engaging and resting on the interior bottom surface of the hopper. This bottom surface supports the packer mechanism in the hopper. At least one power drive mechanism is connected to the packer mechanism for moving the packer mechanism from the retracted position to the extended position in order to sweep deposited waste from the interior space of the hopper through the second aperture and into the storage container and for moving the packer mechanism back to the retracted position during use of the apparatus.

In one particular embodiment of this packing apparatus, the packing mechanism includes a pair of spaced-apart rollers rotatably mounted on a trailing end section of the packer mechanism and the apparatus includes an arcuate guide rail for each of the rollers disposed inside and secured to the hopper. These rollers and guide rails guide movement of the trailing end section of the packer.

According to another embodiment of the invention, a refuse collection vehicle includes a vehicle chassis having front and rear sets of wheels and engine means for driving at least one of the sets of wheels and a vehicle cab mounted on the chassis. A refuse storage container is mounted at a rear of the vehicle chassis, this container having a rear door that can be opened to permit egress of refuse and an interior storage space. A refuse receiving hopper is mounted on the chassis between the cab and the storage container and has an interior space for refuse. A vertically extending divider separates the interior space of the hopper from the storage space of the container. The hopper also includes a substantially arcuate interior bottom surface, a first aperture for depositing refuse or waste into the interior space and a second aperture in or adjacent the divider for passage of refuse from the interior space to the storage space. The interior bottom surface curves in a front to rear direction to a rearmost location adjacent the base of the second aperture. The vehicle further includes a packer mechanism having a waste pushing face at one end thereof, this mechanism being mounted in the hopper for reciprocating movement between a retracted position away from the second aperture and an extended position where the waste pushing face is in or adjacent to the second aperture. The reciprocating movement is along an arcuate path defined at least in part by the interior bottom surface. The packer mechanism has a blade portion with a bottom engaging and resting on the interior bottom surface which supports the packer mechanism in the hopper. At least one power drive mechanism is connected to the packer mechanism for moving the packer mechanism from the retracted position to the extended position in order to sweep deposited refuse from the interior space through the second aperture and into the container and for moving the packer mechanism back to the retracted position during use of the vehicle.

In a further embodiment of the invention, there is provided a refuse collection and transport system that includes a refuse vehicle having a vehicle chassis and a refuse storage container mounted on the chassis and having an interior storage space. The container includes a gate mechanism for opening the container for egress of refuse. A refuse receiving hopper is mounted on the chassis adjacent the storage container and has an interior hopper space for at least initially holding refuse and a substantially concave interior bottom surface arrangement on which refuse can be deposited. The hopper has a first aperture for insertion of refuse into the hopper space and a second aperture for passage of refuse from the hopper space into the storage space. The concave bottom surface curves in a vertical plane perpendicular to the second aperture and extends at least to a point close to a base of the second aperture. A substantially arcuate packing member is slidably mounted within the hopper for movement along an arcuate path at least in part defined by the bottom surface arrangement and is supported by the bottom surface arrangement. The packing member has a refuse engaging face at a first end thereof and is adapted for movement from a retracted position to an extended position, thereby transferring refuse to the storage space through the second aperture. A power drive arrangement is connected to the packer member for providing reciprocating movement of the packer member between the retracted position and the extended position. A guide system is mounted on the hopper and the packer member to guide the packer member along the arcuate path during the reciprocating movement.

In a particular embodiment of the aforementioned collection and transport system, the packing member has a top surface which forms a concave curve extending from the first end thereof to an opposite trailing second end and has a blade portion at the first end and a shield portion at the second end. The shield portion covers and protects at least a portion of the power drive arrangement when the packer member is in the extended position.

DETAILED DESCRIPTION OF THE PREFERRED EMBODIMENTS

Figure 1:
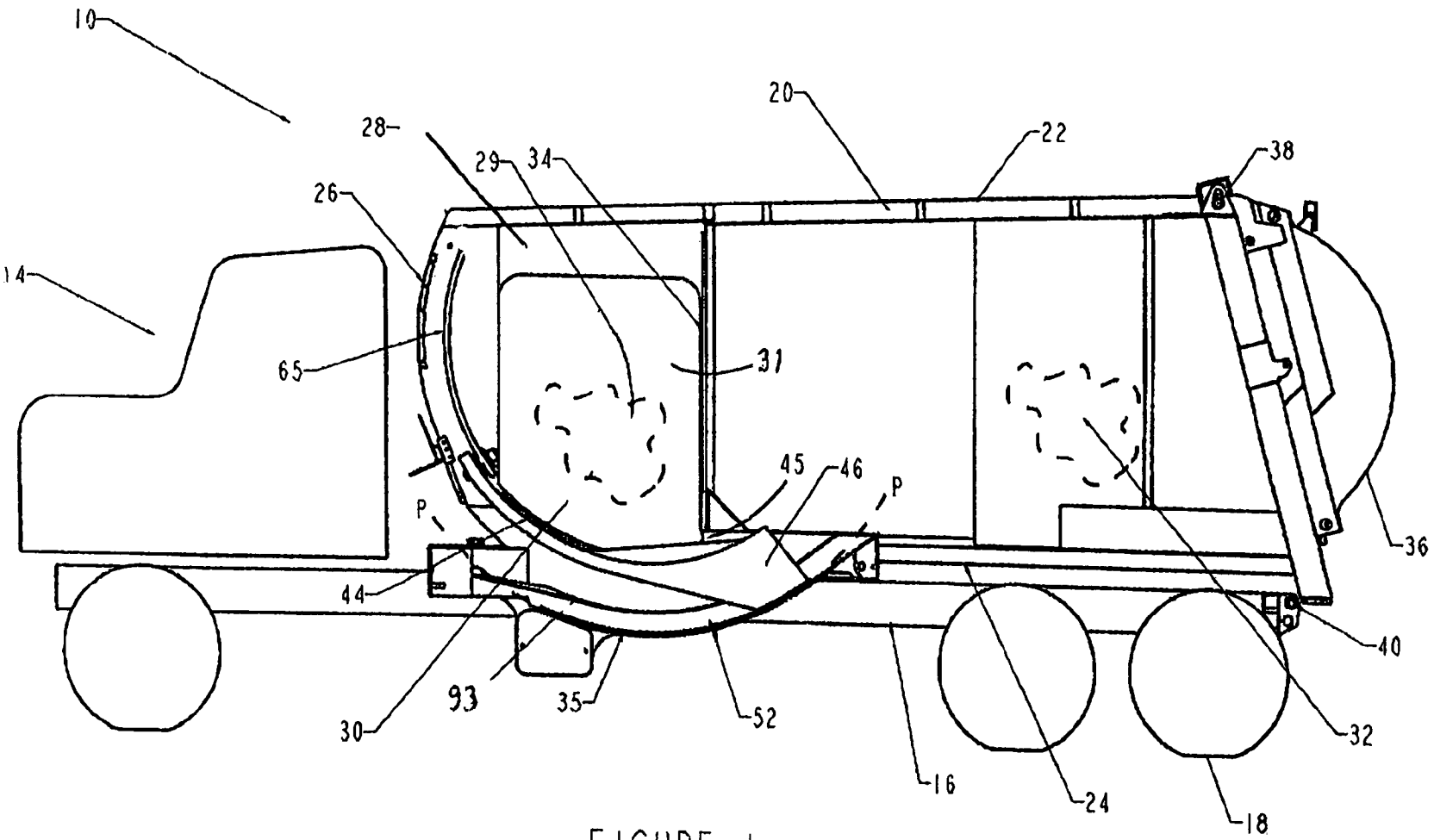
FIG. 1 is a partially cut away, side elevational view of an improved waste collection vehicle and system constructed according to a preferred embodiment of the invention, with portions shown in phantom outline for clarity.

In the following description, similar features in the drawings have been given similar reference numerals.

An improved waste or refuse collection vehicle 10, for collecting, compacting, temporarily storing and transporting waste or refuse, such as household waste, is shown in FIG. 1. The illustrated side loading vehicle facilitates curbside pickup of the waste. The vehicle 10 will be seen to have a cab 14, chassis 16, front and rear sets of wheels 18 and a housing 20. The cab 14 is mounted on the chassis 16. The housing is mounted at the rear of the vehicle behind the cab. The vehicle includes engine means (not shown) for driving at least one set of the wheels.

The housing 20 comprises a top wall 22, a floor portion 24, a front wall 26, a first side wall 28, a second side wall 29 and a further wall or a divider 34, which separates the housing 20 into a hopper 30 and a hold or storage container 32. The refuse storage container 32 is mounted at a rear of the vehicle chassis 16. This container forms an interior storage space for holding and transporting refuse. A first aperture 31 is provided in at least one of the side walls for depositing waste or refuse into an interior space 33 of the hopper 30. Preferably a door (not shown) is provided to permit the aperture 31 to be closed. A second aperture 45 opens into each of the hold 32 and the hopper 30 and has a base 52. The housing 20 is attached to the vehicle 10 by hinge 40 which permits the housing to be pivoted upwardly about the hinge for unloading purposes. A rear door or gate 36 contiguous with the hold 32 is pivotably attached to the housing 20 by a hinge 38, so as to permit the door 36 to be opened when the housing 20 is tipped, in a conventional manner, to empty the hold 32. Thus the gate 36 provides gate means for opening the storage container or hold 32 for egress of refuse.

The floor of the hopper 30 is at least partially sheathed by a pair of arcuate wear plates 58, which straddle a drive shaft tunnel 91 of the vehicle 10. A tunnel cover 93 and the wear plates form portions of an interior arcuate, concave bottom surface 35 of the hopper 30 which curves in a front to rear direction. The wear plates 58 are removably secured to the hopper floor and can be secured by conventional fasteners such as screws or nuts and bolts. A version of these wear plates is constructed out of nickel chromium alloy which is wear resistant. As illustrated, the bottom surface 35 extends through the base 52 of the aperture 45 and defines an arcuate path P-P. The hopper 30 is also provided with a pair of arcuate containment rails 44 spaced above the interior bottom surface 35 and projecting inwardly from the first 28 and second 29 sidewalls of the hopper (see FIGS. 7A to 7C).

Figure 2:
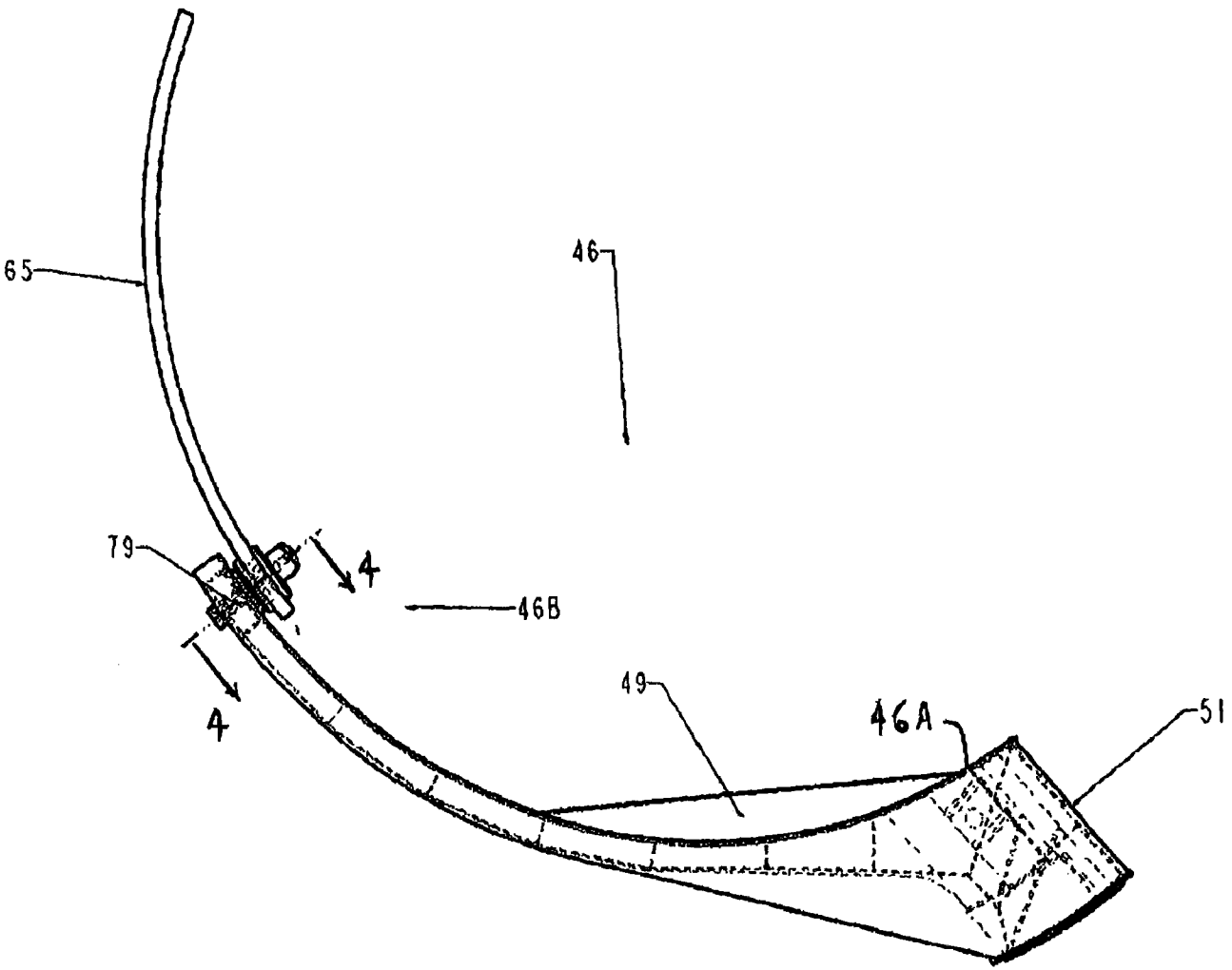
FIG. 2 is an enlarged view of a portion of a packer mechanism shown in FIG. 1.
Figure 3:
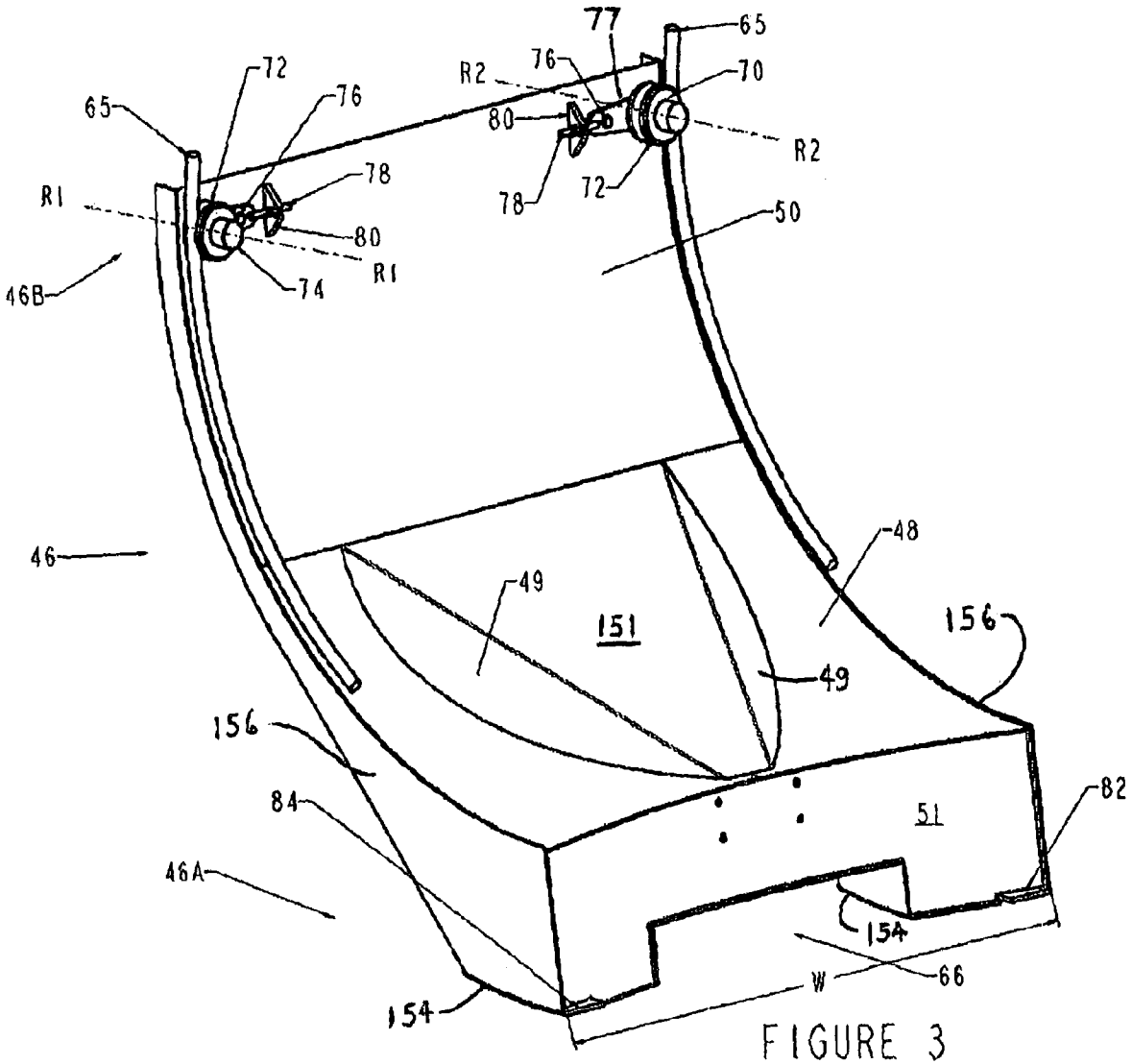
FIG. 3 is a rear, side perspective view of the packer mechanism of FIG. 2.
Figure 4:
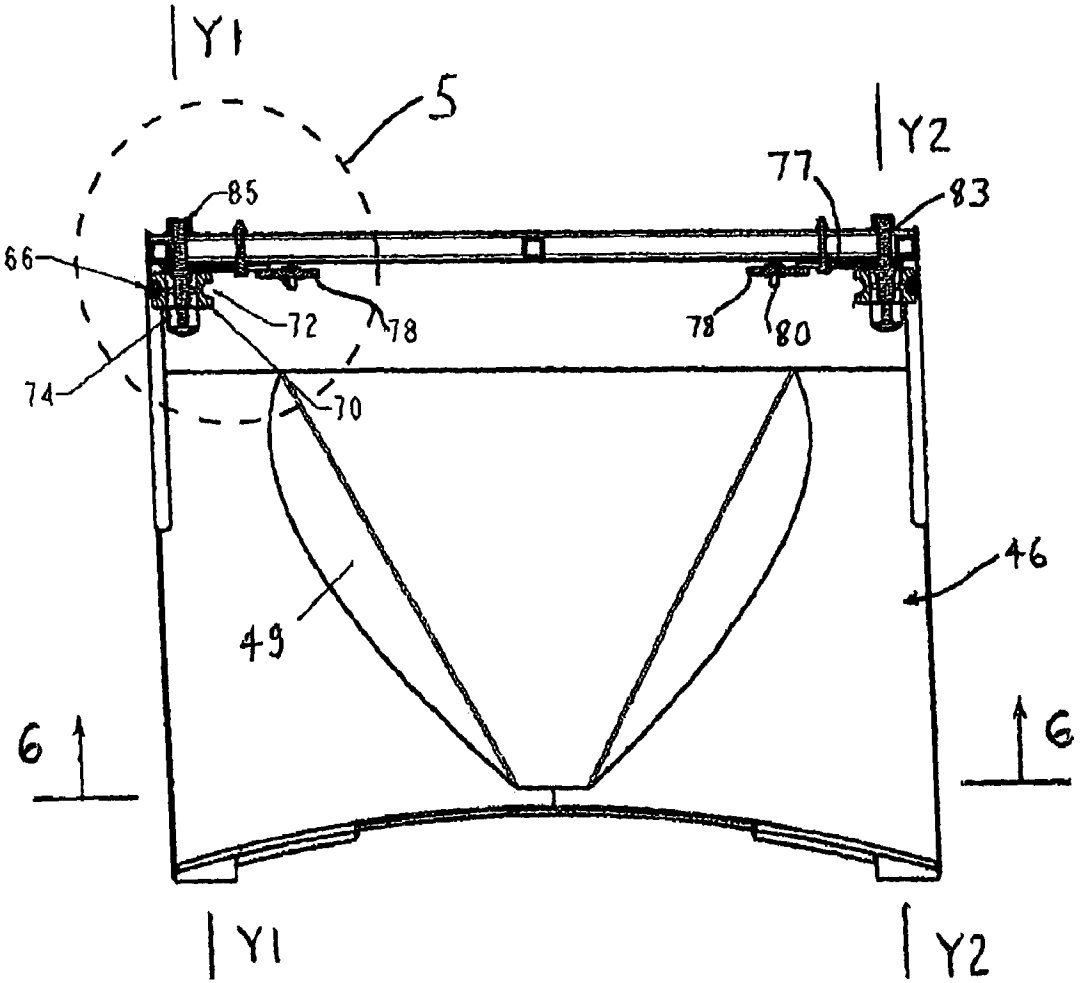
FIG. 4 is a cross-sectional view along line 4-4 of FIG. 2.

Inside the hopper 30, a packer mechanism 46 is provided. As best seen in FIGS. 2, 3, 4, the packer mechanism 46 includes an arcuate packer member extending through a concave curve and having a blade portion 48 which includes a leading end section 46A of the packer 46 and a shield portion 50 which forms a trailing end section 46B. A leading waste pushing face 51 is provided at the leading end of the packer member. The packer 46 defines a central cavity or channel 66 which extends around and accommodates the tunnel cover 93 of the hopper bottom. An underside or bottom of the packer 46 is provided with replaceable wear pads or plates 82, 84 which are constructed out of wear resistant nickel chromium alloy or other suitable wear resistant material. The width w of the packer 46 is slightly less than the distance between the first side wall 28 and the second side wall 29 of the hopper 30. Stiffening webs 49 and triangular connecting plate 151 provide rigidity to the packer 46.

Figure 5:
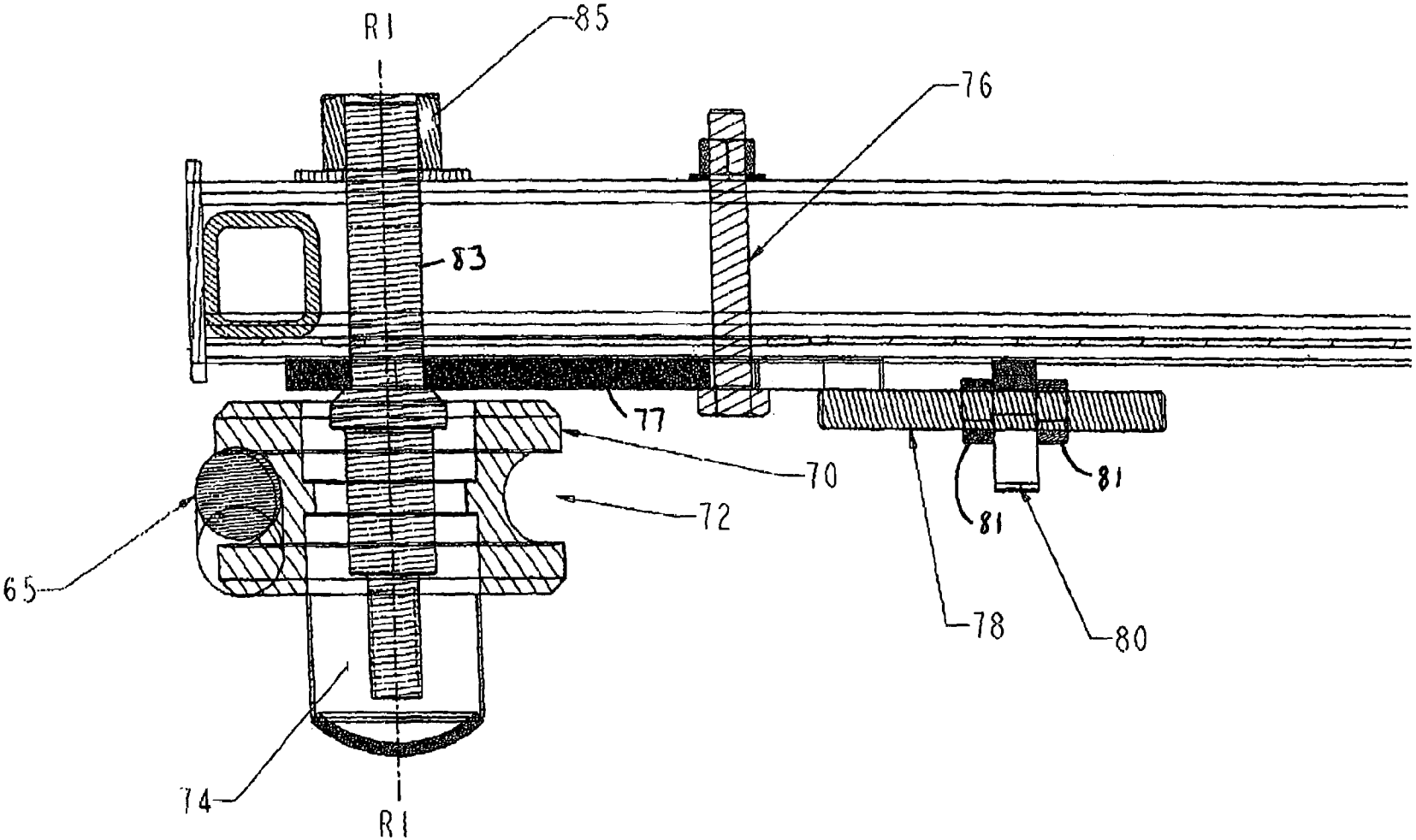
FIG. 5 is an enlarged view of encircled area 5 in FIG. 4, this view showing an adjustable roller for guiding movement of the packer mechanism.

A pair of arcuate guide rails 65 and a pair of rollers 70 are also provided interiorly of the hopper 30. These rails and rollers provide at least part of a guide system to guide the packer member along its arcuate path during its reciprocating movement. The guide rails 65 are rigidly mounted on the inside of respective side walls 28 and 29 of the hopper. The rollers 70 are provided one for each rail 65, and are mounted on the trailing end section 46B of the packer 46, between the rails 65 and horizontally-spaced from one another. The rollers are adjacent opposite sides of the packer member. The rollers 70 are provided with grooves 72 to retain the rails 65 and these grooves can be semi-circular in cross-section as shown in FIG. 5. Each roller 70 is mounted for rotation about a respective rotation axis R1-R1, R2-R2 that is disposed normal to the arcuate path P-P and lies in a respective vertical plane Y1-Y1, Y2-Y2. Each roller 70 is adjustably mounted for movement of its rotation axis in a transverse direction away from or closer to a longitudinal centerline of the packer member. Each roller is mounted by a guide roller bearing 74 which is mounted to the packer 46 by a guide roller bearing nut 85. A bearing shaft 83 extends through a slot 79 formed in the packer 46 adjacent the trailing end 46B. A threaded rod 78 and connecting plate 77 attached to the rod are used to adjust the horizontal position of the bearing 74. The rod 78 is adjustably mounted in a support bracket 80 by means of two nuts 81. The brackets 80 are welded to the packer member 46. A locking bolt 76 can be used to fix the connecting plate in the selected position (see FIG. 5). The connecting plate 77 is fixedly connected to the bearing shaft 83.

Figure 6:
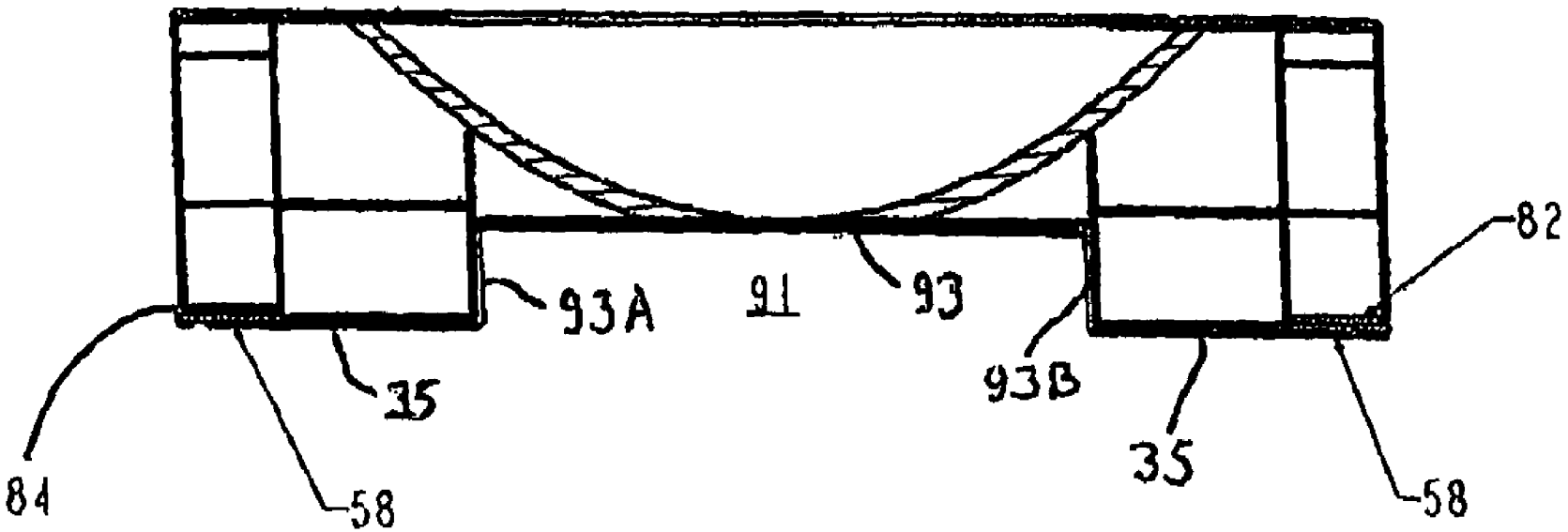
FIG. 6 is a transverse cross-sectional view of the packer mechanism taken along line 6-6 in FIG. 4.
Figure 7A:
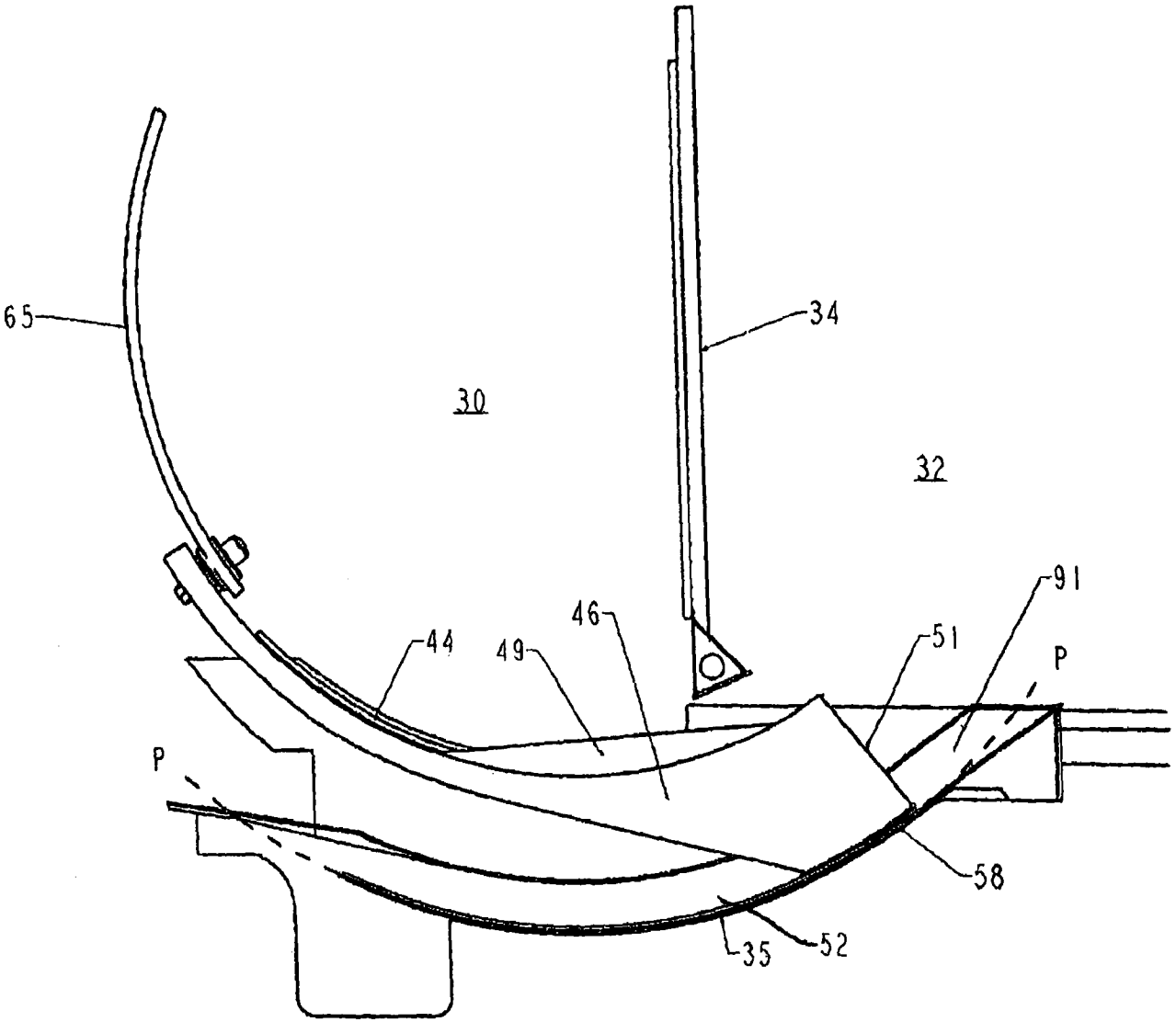
FIG. 7A is an enlarged side view of the interior of the hopper shown in FIG. 1, showing the packer in a deposit position at the end of its rearward extension stroke.
Figure 7B:
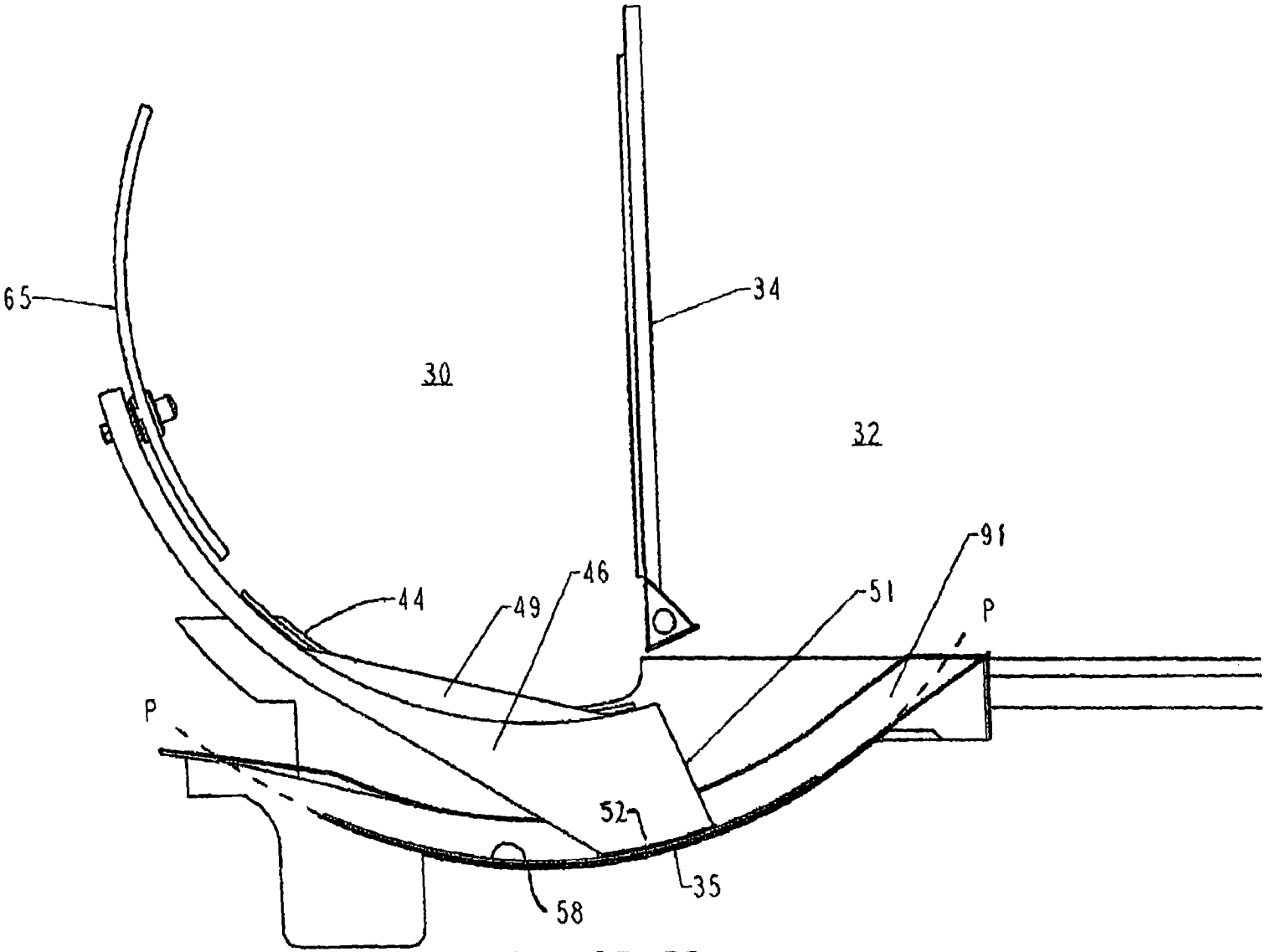
FIG. 7B is view similar to FIG. 7A, showing the packer partially retracted and disposed forwardly from its position in FIG. 7A.
Figure 7C:
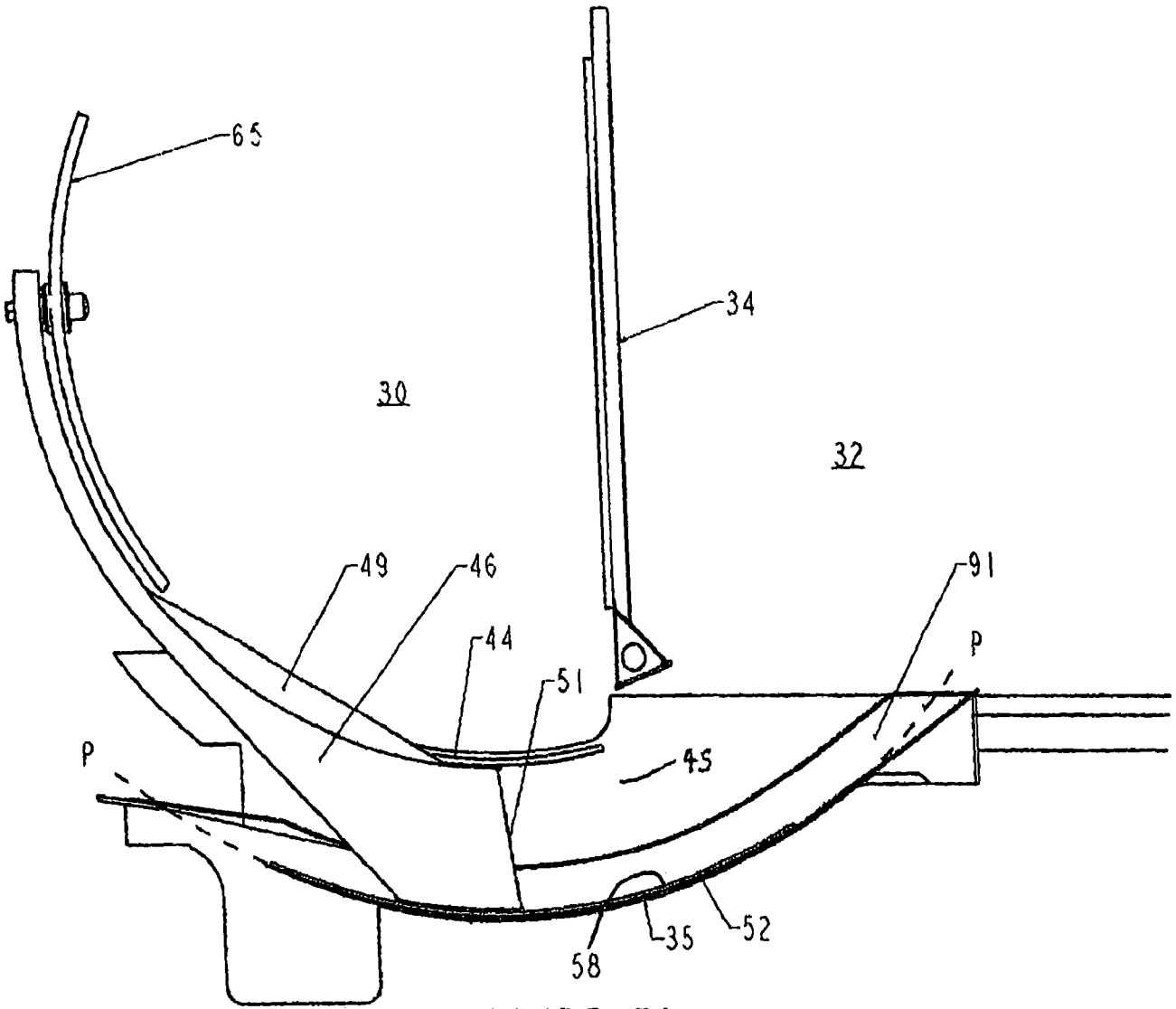
FIG. 7C is a view similar to FIG. 7A, showing the packer retracted further from its position in FIG. 7B.
Figure 7D:
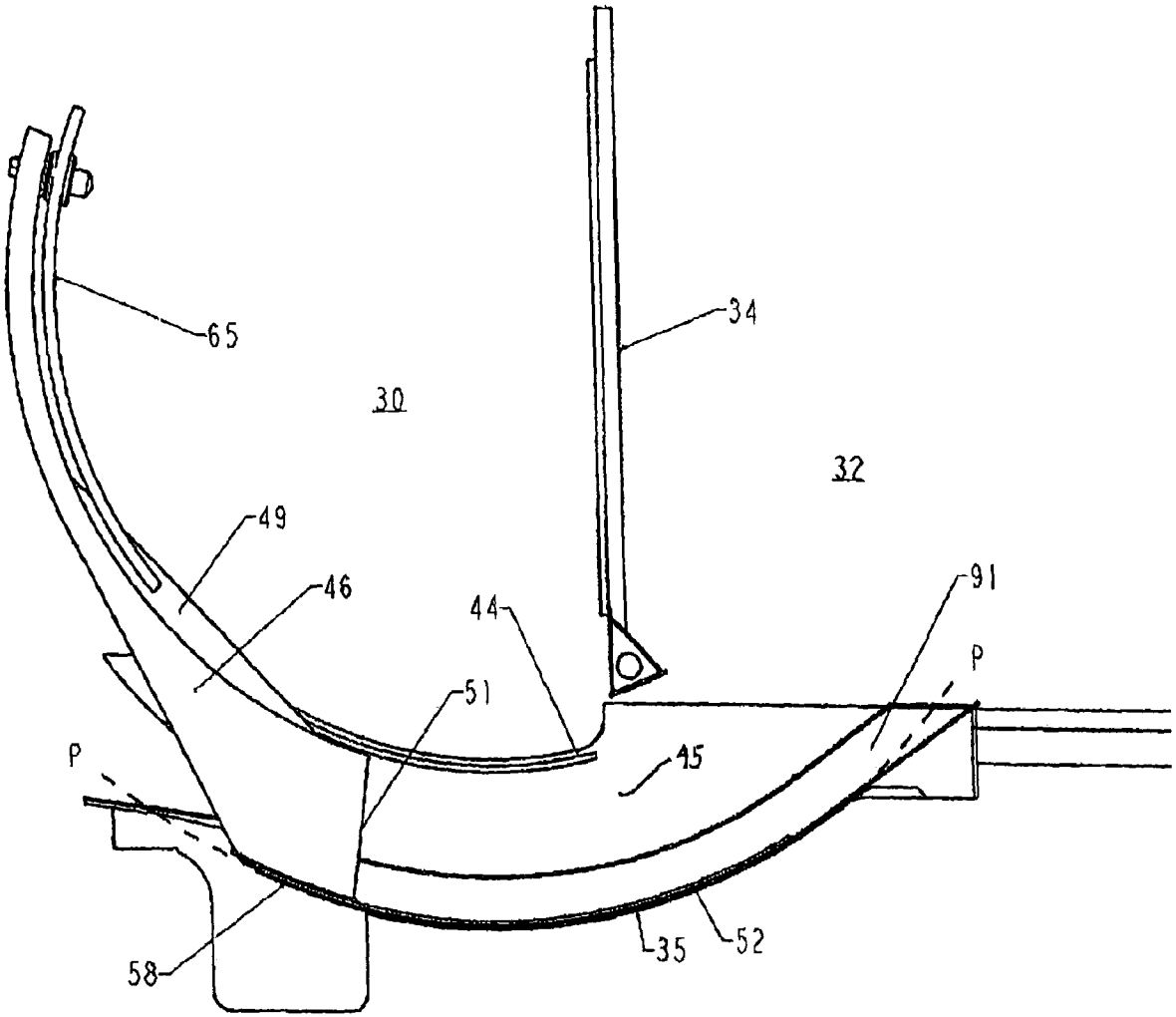
FIG. 7D is a view similar to FIG. 7A, showing the packer at a rest or fully retracted position thereof, at the end of its retraction stroke.

The containment rails 44, the guide rails 65 and the rollers 70 permit the packer 46 to be reciprocable along the arcuate path P-P between a deposit position, shown in FIG. 7A, at the end of a rearward extension stroke of the packer mechanism 46, and a rest position, shown in FIG. 7D, at the end of a frontward, retraction stroke of the packer 46. During this reciprocating movement, the wear plates 82, 84 on the underside of the packer mechanism 46 slide along the wear plates 58 in the hopper 30. The bottom of the blade portion 48 forms at least one convex surface 154 (and as illustrated two such surfaces) as seen from a longitudinal side 156 of the packer mechanism. The at least one convex surface has a curvature matching the curvature of the bottom surface 35. The concave wear plates 58 can extend the length of the arcuate movement of the packer member between its fully retracted position and its fully extended position. As shown in FIG. 6, they can be the same width as and aligned with the respective wear pads 82, 84. The rollers 70 and guide rails 65 guide the trailing end 46B of the packer mechanism 46 along the arcuate path P-P during the reciprocating movement, and the containment rails 44 retain the leading end section 46A against the interior bottom surface 35. Any lateral movement of the packer member 46 is limited by the proximity of the packer member 46 to the first side wall 28 and the second side wall 29. The lateral movement of the packer member 46 within the hopper 30 is also limited by the engagement of the drive shaft tunnel cover 93 in the cavity 66, this cover including vertical side walls 93A and 93B. This arrangement provides for a relatively compact and durable mount of the packer mechanism 46 in the hopper 30. Wear, of course, will occur. Periodic replacement of the wear plates 82, 84, 58 will be required. Similarly, as the roller grooves 72 enlarge through wear, periodic adjustment of the threaded rods 78 will be required, so as to ensure a smooth engagement between the guide rails 65 and the roller grooves 72. Ultimately, once the rollers 70 have worn-out, roller replacement will be required.

Figure 8:
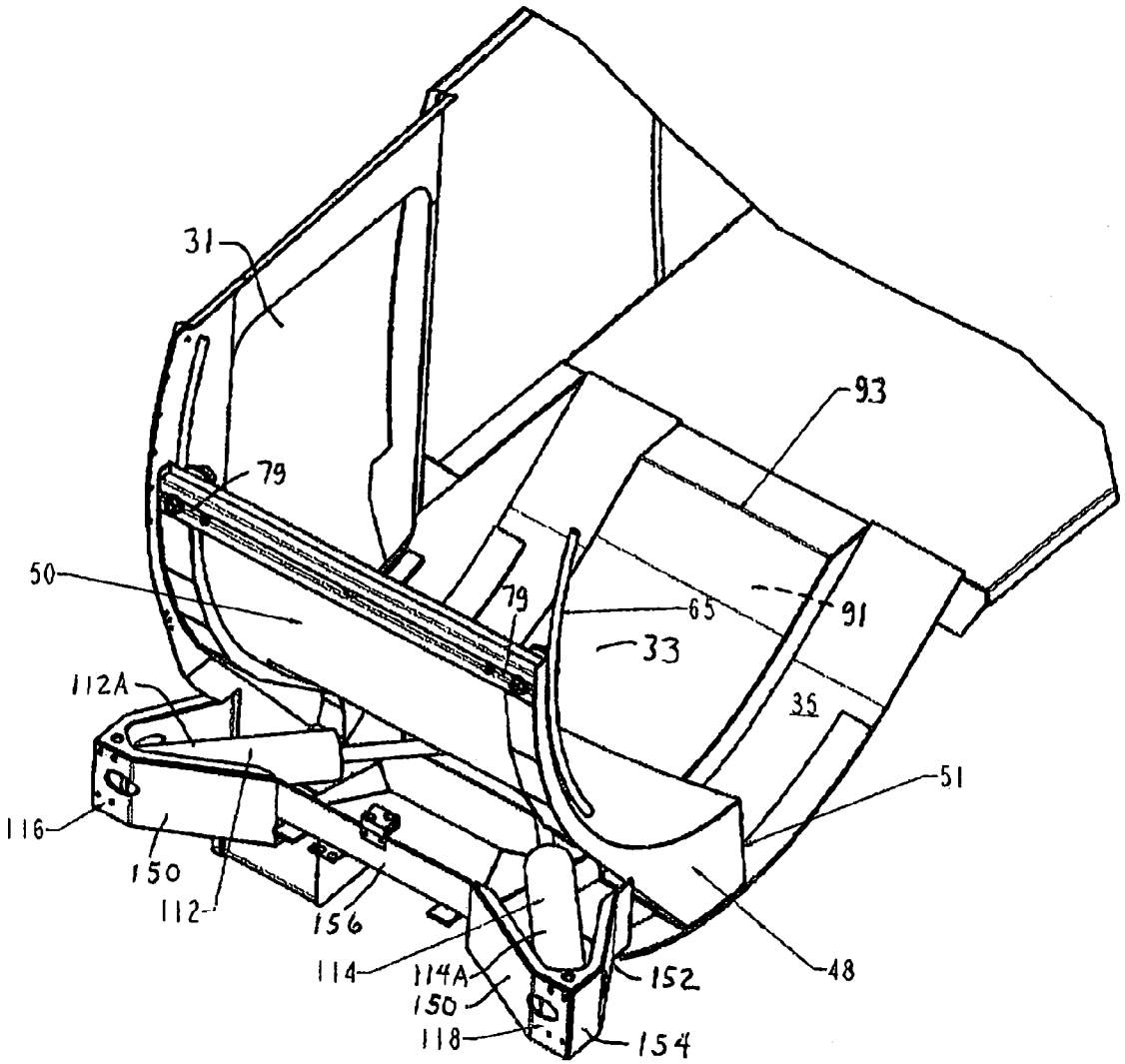
FIG. 8 is a front, side perspective view of a portion of the hopper structure of FIG. 1, with the packer shown at the rest position.
Figure 9:
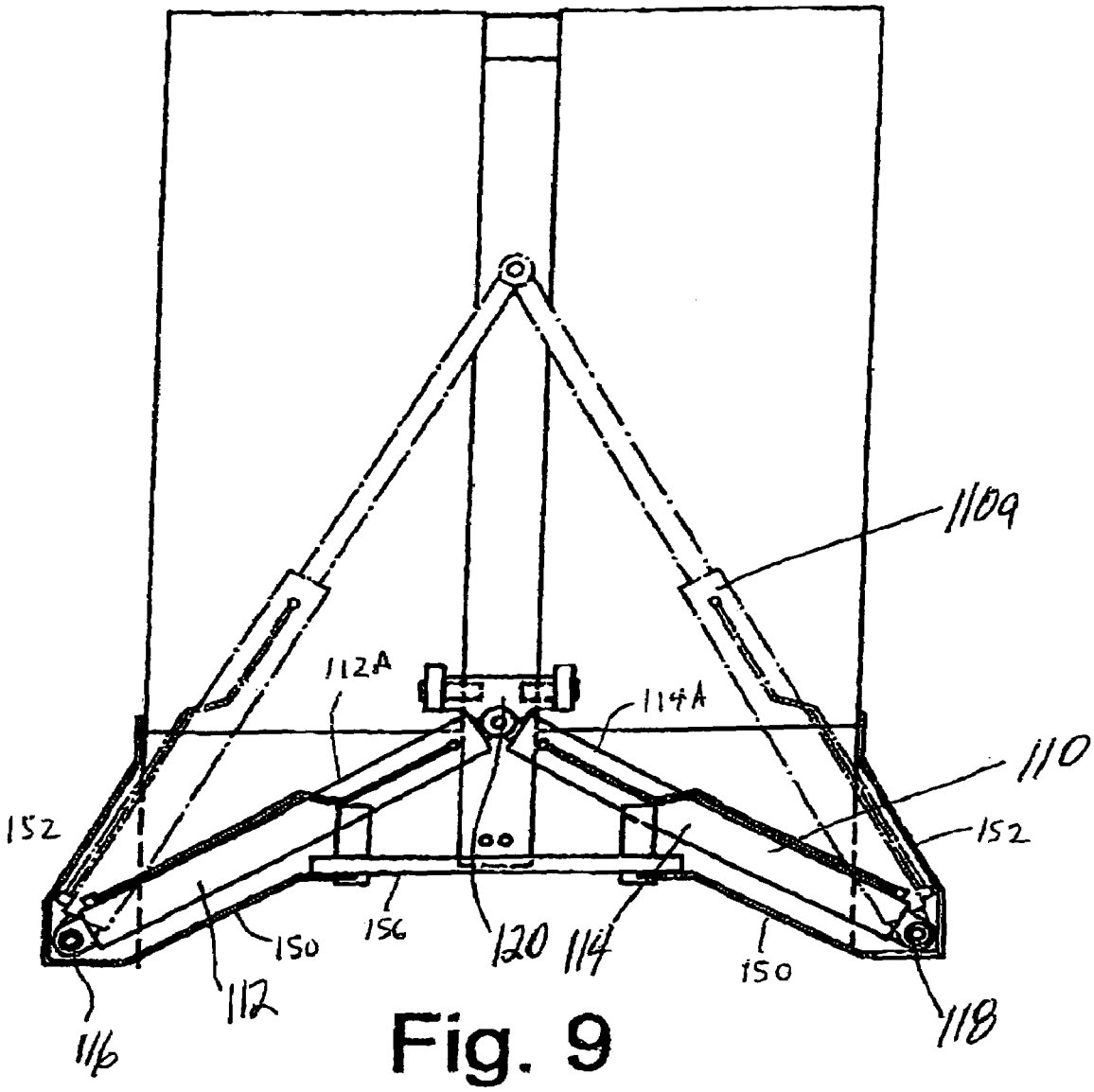
FIG. 9 is a top plan view of the power drive mechanism and a portion of the structure of FIG. 8.

A suitable power drive arrangement such as the illustrated dual hydraulic press or drive mechanism 110 is attached to the packer member 46 as shown in FIGS. 8, 9 and is substantially below an arcuate top of the packer member. In FIG. 9, the mechanism 110 is shown in normal outline as it appears when the packer 46 is in the rest position and is shown in stippled outline as it appears when packer 46 is in the deposit or extended position. The dual hydraulic press mechanism 110 has a first hydraulic cylinder press 112, a second hydraulic cylinder press 114 and brackets 116, 118 and 120. Both the first hydraulic press 112 and the second hydraulic press 114 have a ram and a cylinder. The cylinders of the first hydraulic press 112 and the second hydraulic press 114 are pivotably attached to support brackets 116 and 118 respectively near the front wall 26 of housing 20. Each support bracket includes two horizontal arms 150, 152 which converge to and are joined by a right angled corner member 154. The inner arms 150 are joined to each other by vertical center plate 156. The outer arms 152 are rigidly mounted on the bottom plate of the hopper which forms the bottom surface 35. The rams of the first hydraulic press 112 and the second hydraulic press 11 are pivotably attached to central bracket 120 which is also pivotably attached to the packer mechanism 46. The central bracket is constructed to permit the two rams to pivot both horizontally and vertically relative to the packer member. The hydraulic cylinders 112A and 114A are mounted to their respective brackets 116, 118 using spherical bearings to allow pivotal movement of each cylinder both horizontally and vertically. Routine maintenance and occasional replacement of the bearings and hydraulic cylinders 112, 114 is contemplated, In operation, waste collection commences with the packer in the rest position, as shown in FIG. 7D. In this position, waste, such as household waste, may be introduced into the hopper 30, whereupon it collects on the interior bottom surface 35. To move refuse received within the hopper 30 to the hold 32, the dual hydraulic drive mechanism 110 is activated so as to extend the ram of the first hydraulic press 112 and the ram of the second hydraulic press 114. As seen in FIGS. 7C, 7B and 7A, the packer 46 is thus displaced from the rest position through the hopper 30 along the generally arcuate path P-P to the deposit or extended position.

As the packer 46 advances through the hopper 10, the underside of the blade portion 48 remains flush with the surface 35 such that refuse across the width of the hopper 30 is collected against the leading face 51 of the packer 46 and swept to the aperture 45, for collection in the hold 32. As the packer 46 displaces the refuse from the hopper 30 to the hold 32, the shield portion 50 prevents refuse from falling onto the dual hydraulic drive mechanism 110. In other words, the shield portion acts to protect the power drive mechanism and to prevent refuse from entering the space in front of the packer mechanism. As the packer mechanism 46 reaches the end of its extension stroke, the leading end section 46A of the packer 46 passes beneath the divider 34, and deposits waste into the hold 32. At the end of its extension stroke, the leading end section 46A of the packer 46 of this embodiment has an upward trajectory component, and extends into the storage container beneath the mass of any waste retained in the hold 32. This movement tends to cause compression of the hold 32 contents, so as to maximize its capacity.

The spherical bearings which are used to mount the hydraulic cylinders 112, 114 serve to prevent misalignment of cylinder forces during packing of unbalanced loads. Thereafter, the rams of first hydraulic press 112 and second hydraulic press 114 retract, such that the packer mechanism 46 returns to the rest position, for subsequent cycling, It will be understood that the hopper 30 according to one embodiment of the invention includes the front wall 26, portions of the two sidewalls 28 and 29, and the further wall or divider 34. The second aperture 45 is provided at a bottom end of the further wall.

Numerous modifications may be made to the embodiments as described above without departing from the scope of the invention. For example. whereas the illustration depicts a vehicle adapted to tip dump its load, other modifications are contemplated. An internal hydraulically operated pusher plate, for example, could be utilized to eject the load. Further, whereas the wear plates described are manufactured from nickel chromium alloy, any other material that is relatively resistant to wear, and that provides relatively low sliding resistance, could be employed. Although the entire bottom surface of the hopper could be formed with wear resistant material if desired, this is not essential and it can be only partially covered as indicated in FIG. 6, for example, only where this material engaged by the wear pads or plates 82, 84 of the packer mechanism. As well, whereas dual hydraulic cylinder drives are described, more cylinder drives or only one cylinder drive could be employed. Indeed, hydraulic cylinder drives might be omitted altogether, in favor of pneumatic actuation. Further, whereas the arcuate interior surface of the hopper is described herein to extend through the aperture, this is not necessary in all embodiments. As well, whereas the aperture is indicating to have a base, towards which the arcuate interior surface extends, it is not necessary that the actual lower extent of the aperture through which the hold and hopper communicate coincide with the lower surface upon which the packer slides The packer could, for example, have a projection which extends through the aperture in the deposit position, with the lower interior surface upon which the packer slides stopping somewhat short. Accordingly, the invention should be understood as being limited only by the accompanying claims, purposively construed.

The invention claimed is:

1. A refuse collection vehicle comprising:

a vehicle chassis having front and rear sets of wheels and engine for driving at least one of said sets of wheels;

a vehicle cab mounted on said chassis;

a refuse storage container mounted at a rear of said vehicle chassis, said container having a rear door that can be opened to permit egress of refuse and an interior storage space;

a refuse receiving hopper mounted on said chassis between said cab and said storage container and having an interior space for refuse, a vertically extending divider separating said interior space of the hopper from the storage space of the container, a substantially arcuate, interior bottom surface, a first aperture for depositing refuse or waste into said interior space, and a second aperture in or adjacent said divider for passage of refuse from said interior space to said storage space, said interior bottom surface curving in a front to rear direction to a rearmost location adjacent a base of said second aperture;

two spaced-apart guide rails disposed inside and secured to said hopper;

a packer mechanism having a waste pushing face at one end thereof and mounted in said hopper for reciprocating movement between a retracted position away from said second aperture and an extended position where said waste pushing face is in or adjacent to said second aperture, said reciprocating movement being along an arcuate path defined at least in part by said interior bottom surface, said packer mechanism having a blade portion with a bottom engaging and resting on said interior bottom surface, the latter supporting said packer mechanism in the hopper and a pair of spaced-apart rollers rotatably mounted on opposite sides of a trailing end section of the packer mechanism, each roller mounted to roll along a respective one of said guide rails, said rollers and guide rails guiding movement of the trailing end section of the packer; and at least one power drive mechanism connected to said packer mechanism for moving said packer mechanism from said retracted position to said extended position in order to sweep deposited refuse from said interior space through said second aperture and into said container and for moving said packer mechanism back to said retracted position during use of said vehicle, said trailing end section acting as a shield portion to protect said at least one power drive mechanism from refuse during use of said hopper and said reciprocating movement of said packer mechanism.

2. A vehicle according to claim 1 wherein said rollers are grooved to receive their respective guide rails.

3. A vehicle according to claim 1 wherein said packer mechanism comprises an arcuate packer member which extends through a concave curve as seen from above from said waste pushing face at said one end to an opposite trailing end.

4. A vehicle according to claim 1 wherein said bottom of the blade portion forms at least one convex surface as seen from a longitudinal side of the packer mechanism, said at least one convex surface having a convex surface matching the curvature of said interior bottom surface.

5. A vehicle according to claim 4 wherein said bottom of the blade portion is fitted with replaceable wear pads made of a wear resistant material.

6. A vehicle according to claim 5 wherein said interior bottom surface of said hopper is at least partially covered with wear resistant material which is engaged by said wear pads of the blade portion.

7. A vehicle according to claim 6 wherein both said wear pads and said wear resistant material comprise nickel chromium alloy.

8. A vehicle according to claim 1 wherein said interior bottom surface of said hopper is at least partially covered with wear resistant material which is engaged by the blade portion.

9. A vehicle according to claim 8 wherein a final portion of an extension movement towards the extended position by the blade portion has an upward trajectory component during use thereof and, in said extended position, the blade portion extends into said storage container.

10. A refuse collection and transport system comprising:

a refuse vehicle having a vehicle chassis and a refuse storage container mounted on said vehicle chassis and having an interior storage space and gate for opening said container for egress of refuse;

a refuse receiving hopper mounted on said chassis adjacent said storage container and having an interior hopper space for at least initially holding refuse, a substantially concave interior bottom surface arrangement on which refuse can be deposited, a first aperture for insertion of refuse into said hopper space, and a second aperture for passage of refuse from said hopper space into said storage space, the concave bottom surface curving in a vertical plane perpendicular to said second aperture and extending at least to a point close to a base of said second aperture;

a substantially arcuate packing member slidably mounted within said hopper for movement along an arcuate path at least in part defined by said bottom surface arrangement, supported by said bottom surface arrangement, and having a refuse engaging face at a first end thereof, said packing member adapted for movement from a retracted position to an extended position, thereby transferring refuse to said storage space through said second aperture;

a power drive arrangement connected to said packer member for providing reciprocating movement of the packer member between said retracted position and said extended position; and a guide system mounted on said hopper and said packer member to guide said packer member along said arcuate path during said reciprocating movement, said guide system including a pair of grooved rollers mounted on opposite sides of said packing member adjacent a second end thereof opposite said first end and an arcuate guide rail for each of said rollers arranged in the interior of said hopper and provided on a respective side wall of the hopper, the rollers having rotation axes disposed normal to said arcuate path and lying in respective spaced-apart vertical planes.

11. A system according to claim 10 wherein said packing member has a top surface which forms a concave curve extending from said first end thereof to an opposite trailing second end and has a blade portion at said first end and a shield portion at said second end, said shield portion covering and protecting at least a portion of said power drive arrangement when said packer member is in said extended position.

12. A system according to claim 11 wherein said blade portion has a bottom which forms at least one convex surface as seen from a longitudinal side of the packer member, said at least one convex surface having a convex curvature matching the curvature of the concave bottom surface of the hopper.

13. A system according to claim 12 wherein said at least one convex surface is formed by at least one replaceable wear pad made of wear resistant material.

14. A system according to claim 13 wherein said bottom surface arrangement of the hopper is at least partially covered with wear resistant material which is engaged by said at least one wear pad.

15. A system according to claim 10 wherein said hopper is mounted on said chassis in front of said storage container, said first aperture is formed in a vertical side wall of said hopper, and said second aperture is formed at a bottom end of a vertically extending divider separating said storage space of the container from the hopper space.

16. A system according to claim 10 wherein said rollers are each adjustably mounted on the packing member for movement of the rotation axis of the respective roller in a transverse direction away from or closer to a longitudinal centerline of the packer member.

17. A system according to claim 10 wherein said rollers are grooved.

* * * * *